US009038432B2

(12) United States Patent
Graf et al.

(10) Patent No.: US 9,038,432 B2
(45) Date of Patent: May 26, 2015

(54) APPARATUS AND METHOD FOR PRODUCING SPRINGS

(75) Inventors: Bernhard Graf, Tubach (CH); Michael Egli, Abtwil (CH)

(73) Assignee: Spuhl GmbH, Wittenbach (CH)

( * ) Notice: Subject to any disclaimer, the term of this patent is extended or adjusted under 35 U.S.C. 154(b) by 1038 days.

(21) Appl. No.: 13/130,660

(22) PCT Filed: Nov. 18, 2009

(86) PCT No.: PCT/CH2009/000365

§ 371 (c)(1),
(2), (4) Date: May 23, 2011

(87) PCT Pub. No.: WO2010/060223

PCT Pub. Date: Jun. 3, 2010

(65) Prior Publication Data

US 2011/0226380 A1 Sep. 22, 2011

(30) Foreign Application Priority Data

Nov. 25, 2008 (CH) ..... 1834/08

(51) Int. Cl.

| | |
|---|---|
| ***B21F 3/00*** | (2006.01) |
| ***B21F 1/02*** | (2006.01) |
| ***B21F 35/00*** | (2006.01) |

(52) U.S. Cl.
CPC ... *B21F 3/00* (2013.01); *B21F 1/02* (2013.01); *B21F 35/00* (2013.01)

(58) Field of Classification Search
CPC ..... B21F 3/00; B21F 3/02; B21F 35/00
USPC ..... 140/89, 71 C, 3 CA, 92.1; 72/135, 138, 72/140, 142, 143, 145, 371; 29/896.9
See application file for complete search history.

(56) References Cited

U.S. PATENT DOCUMENTS

| | | | | |
|---|---|---|---|---|
| 2,349,828 | A | 5/1944 | Moray | |
| 2,631,840 | A | 3/1953 | Bugenhagen | |
| 3,402,584 | A | 9/1968 | Cavagnero | |
| 4,424,624 | A * | 1/1984 | Sievers | 72/371 |
| 4,836,514 | A * | 6/1989 | Ulbing | 72/145 |
| 5,103,543 | A * | 4/1992 | Hodgson | 29/896.9 |

FOREIGN PATENT DOCUMENTS

| | | |
|---|---|---|
| DE | 150588 | 4/1904 |
| DE | 19506422 A1 | 8/1996 |
| WO | 2008143595 A1 | 11/2008 |

OTHER PUBLICATIONS

Technische Rundschau: "Federwickelmaschine Fuer Losgroesse 1", Edition Colibri AG., Wabern, Ch, vol. 90, No. 14, Jul. 31, 1998, p. 10, XP000824263, ISSN: 1023-0823, p. 10, figure 3.

* cited by examiner

*Primary Examiner* — Teresa M Ekiert
(74) *Attorney, Agent, or Firm* — The Webb Law Firm

(57) ABSTRACT

Using a method for producing a spring from a spring wire, turns of a first spring part are produced, wherein said produced turns move in a first direction. Thereafter, turns of a second spring part are produced, wherein said produced turns move in a second direction which is different from, in particular opposite of, the first direction. Such a method can be used to produce a spring having a plurality of spring parts.

18 Claims, 8 Drawing Sheets

APPARATUS AND METHOD FOR PRODUCING SPRINGS

BACKGROUND OF THE INVENTION

1. Field of the Invention

The present invention relates to a method for producing springs and to an apparatus for producing springs.

2. Description of the Related Art

From the prior art, pocket springs, configured as multiple compression springs, for mattresses or other lounging and seat cushions. By a multiple compression spring is understood, for example, a spring pair comprising an outer spring and an inner spring. The inner spring is here arranged parallel to the outer spring and is surrounded by the latter. In the region of the pocket springs for mattresses, the inner spring is generally chosen somewhat shorter than the outer spring.

For example, U.S. Pat. No. 2,631,840 shows a multiple compression spring of this kind, in which the inner spring is connected to the outer spring in the lower region.

A drawback with compression springs known from the prior art is that the production method and also the production apparatuses do not yet deliver the desired efficiency.

SUMMARY OF THE INVENTION

Starting from this prior art, the object of the invention is to provide a method and an apparatus which is capable of producing a spring for mattresses or other lounging and seat cushions in a simple manner.

According to an embodiment of the claimed invention, a spring is produced from a spring wire. Here coils or coils of a first spring part are produced, which produced coils move in a first direction. Thereafter, coils or turns of a second spring part are produced, which latter produced coils movie n a second direction which is different from, in particular opposite to, the first direction.

With such a method, a spring having a plurality of spring parts can be produced in a simple manner. The spring parts can here be arranged such that they wholly or partially intersperse. In particular it is possible, with such a method, to produce double springs of any chosen shape, diameter, pitch and/or number of coils.

The first direction and the second direction run preferably parallel to the respective center axis of the first and second spring part. In the production of the first spring part, this is thus moved in the direction of its center axis in the first direction, while the second spring part extends in the direction of its center axis in the second direction. The coils of the first spring part and of the second spring part extend preferably in the same direction of rotation, i.e. either clockwise or counterclockwise.

Preferably, the spring wire is fed to a forming roller and to a first deflection element, so that the coils of the first spring part are produced such that they move along a first center axis in the first direction. Thereafter, the first deflection element is replaced by a second deflection element, so that the coils of the second spring part are produced such that they move along a second center axis in the second direction.

In the changeover from the first deflection element to the second deflection element, the forming roller is preferably pivoted, whereby from the end coils of the first spring part and of the second spring part is formed a transition portion, by which the first spring part is connected to the second spring part. By the transition portion, the first spring part is connected to the second spring part, so that a one-piece spring is produced.

Preferably, to alter the pitch of the first spring part, the first deflection element is displaced relative to the forming roller, and/or, to alter the pitch of the second spring part, the second deflection element is displaced relative to the forming roller. Both the first spring part and the second spring part can hence be configured with a pitch which varies over the respective length.

To alter the diameter of the first spring part and/or of the second spring part, the forming roller is moved. Both the first spring part and the second spring part can hence be configured with a diameter which varies over the respective length, which allows a spring of any chosen shape or form to be produced.

Preferably, the spring wire, before it impinges on the forming roller, is diverted by a guide element in the direction of the forming roller, the guide element diverting the spring wire only until such time as a first complete coil is formed. As a result of this diversion, the spring wire can be fed at a higher speed, which speeds up the production.

Preferably, the spring wire, after having left the forming roller and/or the deflection elements, is diverted by a further guide element in the first or second direction, the further guide element diverting the spring wire until such time as at least a first complete coil is formed.

Preferably, the spring is configured as a multiple compression spring, the first spring part being an inner compression spring part and the second spring part being an outer compression spring part. The inner compression spring part is disposed within the outer compression spring part. The inner compression spring part is here surrounded by the outer compression spring part. Preferably, the inner compression spring part is configured shorter in respect of the center axis than the outer compression spring part.

Preferably, in addition to the first spring part and to the second spring part, a third, fourth, fifth or sixth spring part is produced.

By means of an apparatus for producing a spring from a spring wire, coils of a first spring part can be produced by means of a forming unit, said produced coils being movable in a first direction. Thereafter, coils of a second spring part can be produced with the forming unit, these produced coils being movable in a second direction which is different from, in particular opposite to, the first direction.

Preferably, the forming unit comprises at least one forming roller, a first deflection element and a second deflection element. The spring wire can be fed to the forming roller, whereupon the forming roller forms the spring wire. The first deflection element is designed to define the pitch of the first spring part and the second deflection element is designed to define the pitch of the second spring part.

Preferably, both the first deflection element and the second deflection element are movable from a rest position into an active position, in which the deflection elements deflect the spring wire respectively such that the coils of the first spring part are movable in the first direction and that the coils of the second spring part are movable in the second direction.

Preferably, the first deflection element and the second deflection element are displaceable with respect to the forming roller, whereby the pitch of the respective spring part is adjustable. If a displacement takes place during the production of the respective spring part, the pitch of this spring part can be configured such that it is variable over the length of said spring part.

Preferably, the forming roller is pivotably arranged, so that the diameter of the respective spring part is variable. If a pivot takes place during the production of the respective spring part, the diameter of each individual spring part can be configured such that it is variable over the length of said spring part. The spring part can hence be configured in any chosen shape.

Advantageous embodiments of the invention are defined in the dependent claims.

BRIEF DESCRIPTION OF THE DRAWINGS

A preferred embodiment of the invention is described in greater detail below, by way of example, with reference to the drawing, wherein.

DETAILED DESCRIPTION OF THE EMBODIMENTS

Possible illustrative embodiments are described with reference to the drawings. The drawings and the description show preferred illustrative embodiments and should not be interpreted in such a way as to restrict the invention which is defined by the claims.

Below, the term "multiple spring" is used. By a multiple spring is understood any spring which comprises a plurality of mutually connected individual spring parts. The individual spring parts have different diameters, which allows the individual spring parts to be arranged one inside the other. In other words, it can also be said that by a multiple spring is understood a spring which comprises a plurality of spring parts arranged one inside the other and connected one to another. The spring parts can have different or same lengths. Springs of this type are inserted, for example, as multiple pocket springs into a corresponding pocket spring strip for mattresses or other lounging cushions and seat cushions. The apparatus and the method for producing a spring are explained below, by way of example, on the basis of the double compression spring 1.

Figure 1:
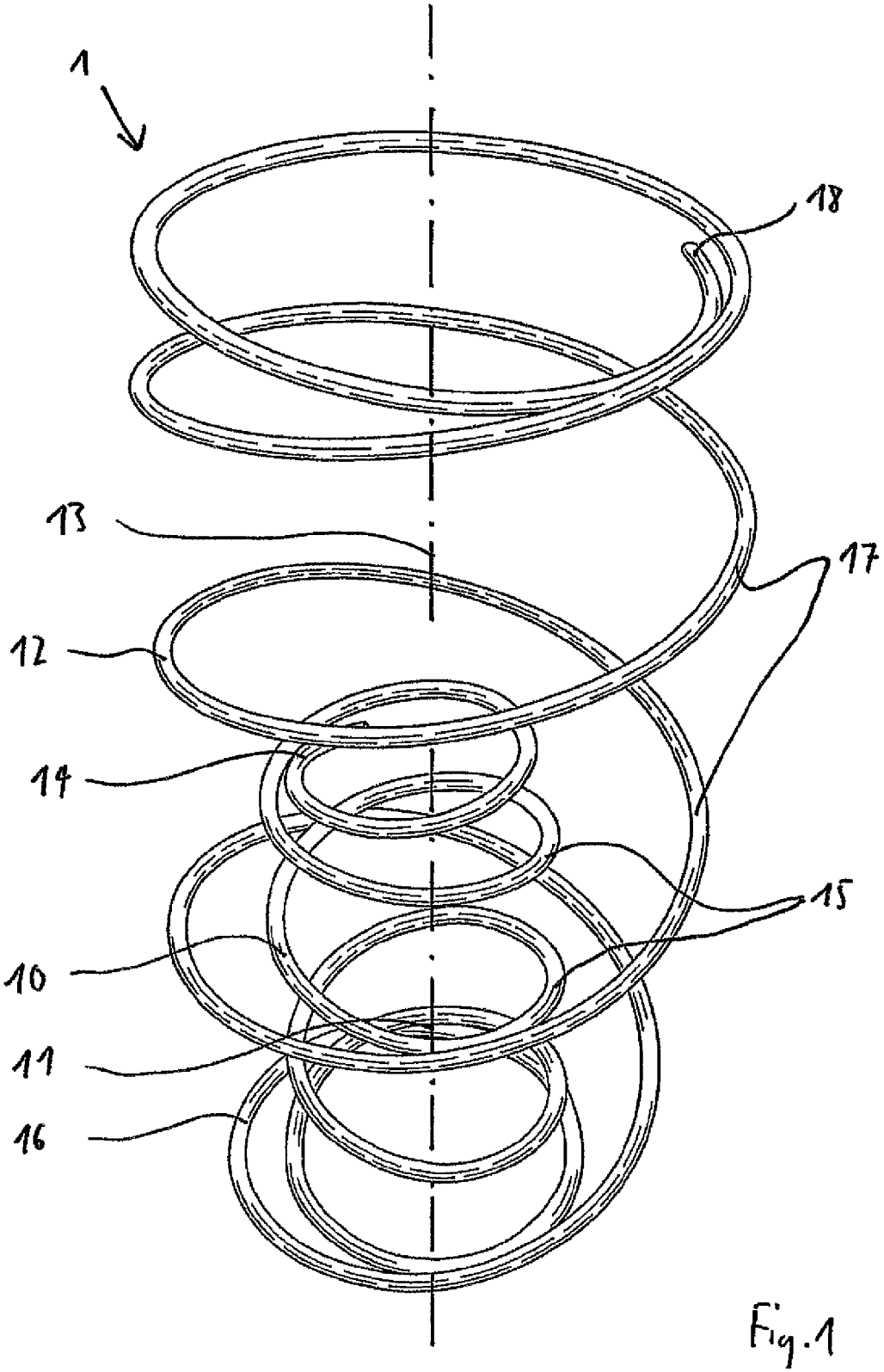
FIG. 1 shows a perspective view of a multiple compression spring.

In FIG. 1, a multiple spring is represented as a double compression spring 1. The double compression spring 1 essentially comprises an inner compression spring or a first spring part 10, having a first center axis 11, and an outer compression spring or a second spring part 12, connected to the inner compression spring 10 and having a second center axis 13. The inner compression spring 10 is disposed within the outer compression spring 12, the first center axis 11 running substantially parallel to the second center axis 13, particularly preferably the two center axes 11, 13 running collinearly with each other. The inner compression spring 10 has a smaller outer diameter than the outer compression spring 12.

The inner compression spring 10 or the first spring part comprises a first, preferably free end 14, to which the inner spring coils 15 are joined. The inner spring coils 15 pass via a transition portion 16, which is formed by the end coils of the respective compression spring 10, 12, into the outer spring coils 17 of the outer compression spring 12. Viewed in the direction of the center axis 11, the transition portion 16 lies opposite the first end 14. The diameter of the transition portion 16 continuously increases from the end of the last inner spring coil 15 to the start of the first outer spring coil 17 or second spring part. The outer spring coils 17 of the outer compression spring 12 accordingly extend from the transition portion 16 in the direction of the second center axis to the second, preferably free end 18. The outer compression spring 12 and the inner compression spring 10 are integrally connected to each other.

Preferably, a multiple compression spring 1 is composed of a plurality of compression springs 11, 12, the compression springs 11, 12 being respectively formed onto each other via a transition region 16, so that the multiple compression spring 1 is configured in one piece.

Preferably, the inner compression spring 10 is configured shorter than the outer compression spring 12. When the outer compression spring 12 is subjected to load in the region of the second end 18, the outer compression spring 12, in a first step, is compressed. The outer compression spring 12 is accordingly compressed with a first spring rate. If the outer compression spring 12 is compressed to the point where it has the length of the inner compression spring 10 and the load persists, the inner spring 10 is likewise compressed, in which case the outer compression spring 12 and the inner compression spring 10 are connected in parallel. The spring rate is then made up of the first spring rate of the outer compression spring 12 and the spring rate of the inner compression spring 10.

In other embodiments, the multiple compression spring can have additional springs, so that three, four, five or six or more compression springs are arranged one inside the other. These compression springs, too, are configured in one piece and can have different or same lengths.

The pitch of the inner compression spring 10 and of the outer compression spring 12 can be constant over the whole of the spring length. Alternatively, the pitch can also be configured such that it is variable over the length. The inner compression spring 10 can also have a different pitch than the outer compression spring.

Preferably, both the inner compression spring 10 and the outer compression spring 12 are of cylindrical configuration. It is also conceivable, however, to configure the springs in the shape of a barrel or cone. Particularly preferably, the inner compression spring is of cylindrical or conical configuration, while the outer compression spring 12 is of barrel-shaped configuration.

Figure 2:
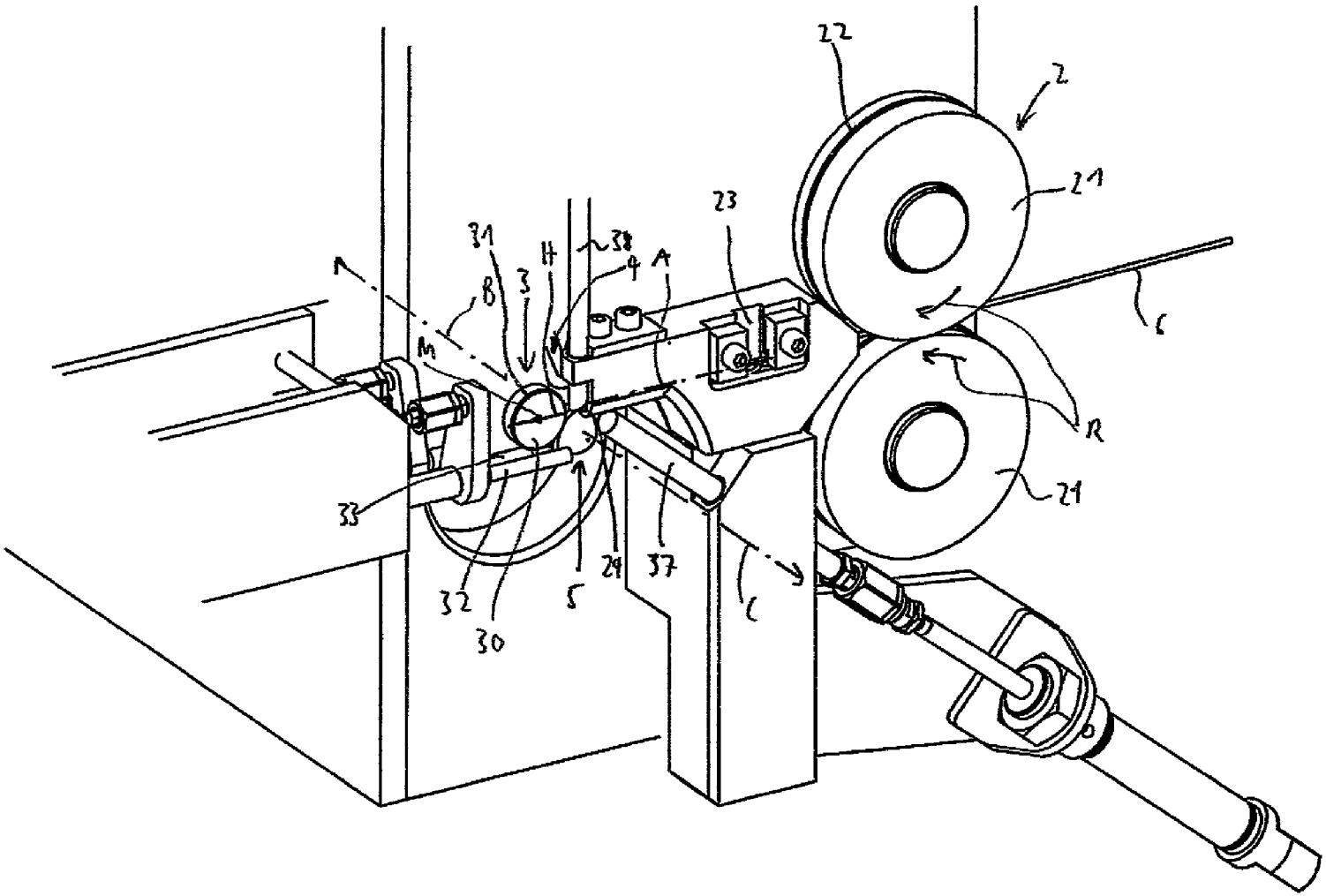
FIG. 2 shows a perspective view from above of relevant elements of an apparatus for producing a multiple compression spring according to the present invention.

Basic parts of an apparatus for producing a herein described multiple compression spring are shown in FIG. 2. At this point it should be noted that the apparatus is quite capable of producing other compression springs, such as, for example, a simple compression spring with constant or variable pitch and/or constant or variable diameter.

The apparatus for producing compression springs, in particular multiple compression springs, essentially comprises a feed unit 2, a forming unit 3, a cutting unit 4 and a guide unit 5.

The feed unit 2 serves to feed the spring wire 6 to the forming unit 3. The spring wire 6 is reshaped into the multiple compression spring 1 by the forming unit 3. Following the forming operation, the multiple compression spring 1 is separated from the spring wire 6 by means of the cutting unit 4. The guide unit 5 serves to guide the multiple compression spring 1 during the forming operation.

The feed unit 2 comprises paired rollers 21, which, through rotation R, give the spring wire 6 its forward thrust, and a lead-in section 23, which feeds the spring wire 6 to the forming unit 3 at the appropriate position.

The rollers 21 each respectively comprise on their surface a groove 22, in which the spring wire 6 is guided. The upper roller 21 here rotates clockwise, while the lower roller 21 rotates counterclockwise, so that the spring wire 6 placed between the two rollers 21 is advanced in the direction of the lead-in section 23. The lead-in section 23 has essentially an opening 24, which extends through the lead-in section 23 and through which the spring wire 6 is advanced. As soon as the spring wire has left the opening 24, it meets the forming unit 3. The opening 24 provides with its center axis a reference axis A, along which the spring wire 6 runs.

The forming unit or spring coiling unit 3 essentially comprises a forming roller 30 having a forming groove 31, as well as a first deflection element 32 and a second deflection element 33. The forming roller 30 influences the diameter of the compression spring to be coiled, while the deflection elements 32, 33 influence the pitch of the compression spring.

The forming roller 30 is arranged in such a way relative to the opening 24 that the spring wire 6 meets the forming groove 31, so that the spring wire 6 is deflected along a circular path, whereupon the compression spring 1 is formed. A plane extending parallel to the reference axis A and through the center point M of the forming roller 30 can be defined as the principal plane H. The forming roller 30 can here be positioned with the principal plane H or with the center point M relative to the reference axis A of the opening 24. Through the relative positioning, the diameter of the compression spring is adapted. The principal plane H is preferably horizontal.

In addition, a reference plane is defined here, which reference plane runs essentially through the forming groove 31 and through the reference axis A. From this reference plane, a direction B extends in one direction to the rear and a direction C extends in the other direction to the front. In the present embodiment, the inner compression spring 10 is advanced or moved in the direction B, and the outer compression spring 12 in the direction C.

The forming roller 30 is preferably movable in the reference plane by means of a swivel motion.

The deflection elements 32, 33 serve for the deflection of the spring wire after this has been reshaped by the forming groove 31. Both deflection elements 32, 33 are here cylindrically configured and can be moved along the respective center axis. Preferably, the deflection elements 32, 33 are moved by respectively a pneumatic cylinder or a hydraulic cylinder. The deflection elements 32, 33 are movable from a rest position into an active position. The active position is defined as the position in which the spring wire 6 is in contact with the appropriate deflection element 32, 33. The spring wire 6 is here in contact either with the first deflection element 32 or with the second deflection element 33. In FIG. 2, the deflection element 32 is in the active position. Preferably, the deflection elements 32, 33 are arranged parallel to each other. Both deflection elements 32, 33 respectively comprise a deflection surface 35, 36, by means of which the spring wire 6 is deflected.

If the first deflection element 32 is arranged in its active position, then the compression spring 10 is coiled along the first center axis 11, the coils of the produced first compression spring 10 moving or extending in this case in the direction B. The direction B runs substantially perpendicular to the center axis A and parallel to the principal plane H rearward from the deflection surface 35 of the first deflection element 32 or from the reference plane.

Thereafter, the second deflection element 33 is arranged in the active position, so that the compression spring 12 is coiled along the second center axis 13, the coils of the produced second compression spring 12 moving or extending in this case in the direction C. The direction C runs substantially perpendicular to the center axis A and parallel to the principal plane H forward from the deflection surface of the second deflection element 33 or from the reference plane.

Both the first deflection element 32 and the second deflection element 33 stand, in the active position, offset from the reference plane in the direction in which the compression spring is intended to extend. The pitch of the compression spring is defined by the distance between the reference plane or forming groove 31 and the deflection surface 35, 36 of the respective deflection element 32, 33. The working of the deflection elements 32, 33 is explained in detail below with the further figures.

The forming unit 3 optionally comprises a guide element 38, which can be termed the upper guide element 38. The upper guide element 38 has a guide surface 380, which forces the spring wire 6, directly after its exit from the opening 24, in the appropriate direction, so that the spring wire, already slightly preformed, meets the forming groove 31. The guide surface 380 here stands at an angle to the reference axis A. That position of the guide element 38 in which the spring wire 6 is deflected by the guide element 38 can be termed the active position. As soon as the spring wire is in contact with the forming roller 30, the guide element 38 is withdrawn again, whereupon it is then no longer engaged with the spring wire 6 and is in the rest position.

The forming unit 3 also preferably comprises a further guide element 37, which can be termed the lower guide element 37. Viewed in the direction of the spring coil, the lower guide element 37 is disposed after the two deflection elements 32, 33. In the case of the first coil of the compression spring, the lower guide element 37 engages for support purposes, in order to define or support the direction in which the compression spring is intended to extend. The guide element 37 is then in the active position and can be moved from this into a rest position.

The cutting unit 4 stands substantially perpendicular to the reference axis A and at an angle to the directions B and C. The cutting unit 4 essentially comprises a cutting tool 40 having a cutting blade 41, which cutting tool cuts through the spring wire, following completed winding, in the region of the opening 24. For this purpose, the cutting tool 40 is moved in such a way that it passes over the axis A with the cutting blade 41 as it cuts through the spring wire 6.

The guide unit 5 here essentially comprises a rear guide pin 50 and a front guide pin, which latter is not shown here. The two guide pins 50 are movable parallel to the center axes of the inner compression spring 10 and the outer compression spring 12 respectively, or to the reference axes B and C. During the forming operation, the two guide pins 50 project into the region of the emerging compression spring, so that vibrations of the compression spring can be absorbed by the guide pins. Alternatively, just one guide pin, preferably the rear guide pin 50, may also be provided. Preferably, the guide pin 50 projects through the spring in such a way that it does not touch the spring, but acts as support if the spring is set in vibrations. For this purpose, the guide pin 50 has a diameter which is smaller than the smallest diameter of the inner compression spring 10.

In an alternative embodiment, in which a front and a rear guide pin are provided, the rear guide pin can be arranged fixed, i.e. immovably, and the front guide pin can be moved relative to the rear guide pin.

FIGS. 3 to 8 show the production of a compression spring described in the introduction.

Figure 3:
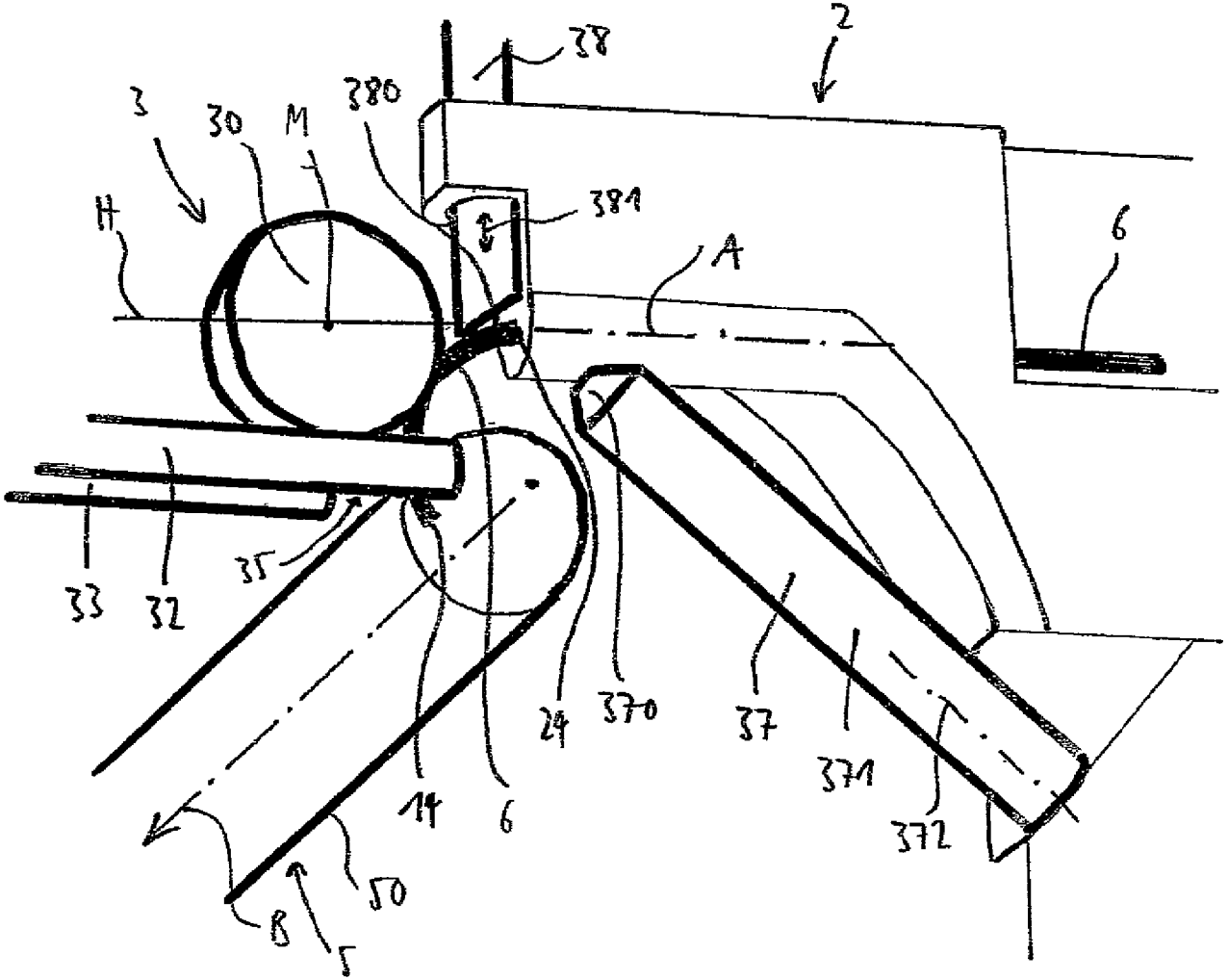
FIGS. 3-8 show perspective views of the apparatus according to FIG. 1 in several method steps.

In a first step, as is represented in FIG. 3, the spring wire 6 is fed by means of the feed unit 2 to the forming unit 3. The front end of the spring wire 6 hereupon meets the forming groove 31 in the forming roller 30. The forming roller 30 is here placed relative to the opening 24 such that the spring wire 6 meets the forming groove 31 beneath the horizontally lying principal plane H. As shown in FIG. 3, the spring wire is thereby deflected downward from the principal plane H.

Following the diversion through the forming groove 31, the spring wire 6 meets the deflection surface 35 of the first deflection element 32. The first deflection element 32 is here in its active position or in the front position and is arranged relative to the opening 24 and to the forming groove 31 such that the deflection surface 35 is arranged offset by a certain distance in the direction in which the spring wire 6 is intended to be wound. The distance substantially corresponds to the pitch of the spring. In other words, it can also be stated that the deflection surface 35 is arranged offset from the reference plane in the direction of the direction B.

Before the spring wire 6 impinges on the forming unit 3, the spring wire 6 is appropriately guided by means of the upper guide element 38. In FIG. 3, it is shown that the upper guide element 38, with its beveled surface 380, preforms the spring wire 6 in the direction of the forming roller 30. This has a positive effect upon the precision and output of the machine, since the spring wire is advanced at a higher speed. As soon as the spring wire 6 is in contact with the forming roller 30, the upper guide element 38 is moved away from the corresponding location. The arrow 381 represents the motional direction of the upper guide element 38.

As soon as the spring wire 6 has left the deflection surface 35 with its free end 14, the spring wire 6 meets the optionally provided lower guide element 37. The lower guide element 37 is of substantially cylindrical configuration and comprises a conical tip 370 and a shell surface 371. The spring wire 6 is further deflected by this guide element 37 by virtue of the conical tip 370 or the shell surface 371 and further support that directional guidance of the spring wire 6 which has already been provided by the deflection surface 35 is further supported. The lower guide element 37 is withdrawn along its center axis 372 from the active position to the rest position as soon as the spring wire has been led in the corresponding direction, in this case the direction B.

Before, during or after the impingement of the spring wire 6 on the forming groove 31, the rear guide pin 50 is additionally advanced forward in the direction of the reference plane. In an alternative embodiment, the guide pin 50 can already be in the front region when the spring coiling operation begins. The guide pin 50 serves essentially to guide the compression spring in order to prevent this from being set in vibration during production.

Figure 4:
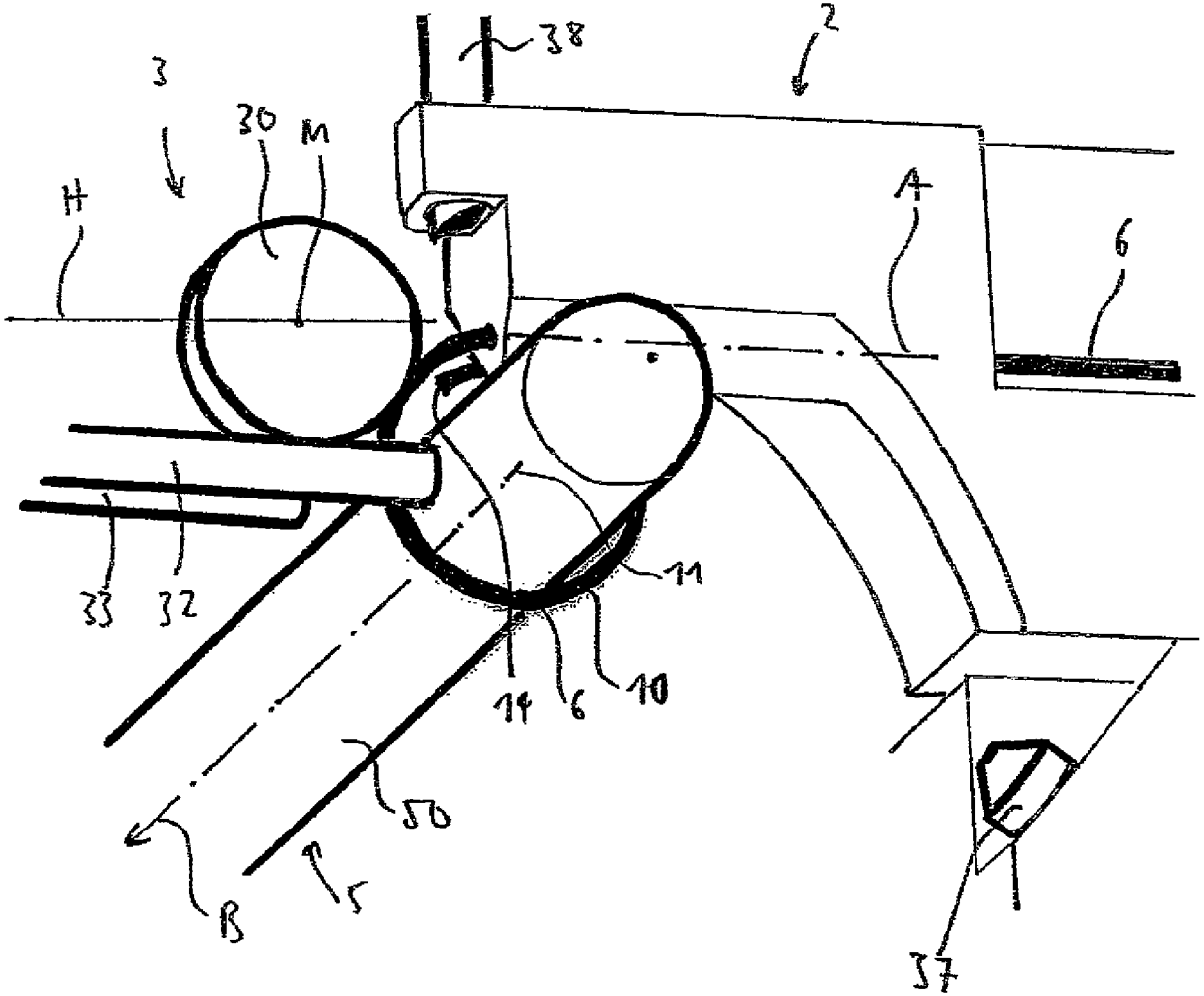

In FIG. 4, it is now shown that, upon a further forward thrust of the spring wire, this is reshaped in such a way that the inner compression spring 10 is formed. In FIG. 4, the inner compression spring 10 is shown with a first convolution. In this figure, it can now be seen that the coil of the inner compression spring 10 extends during production in the direction B rearward from the reference plane. Viewed in the direction B, the front end 14 here moves in the counterclockwise direction.

The forward thrust of the spring wire persists until such time as the desired length of the inner compression spring 10 is reached.

During the forming of the spring wire 6 into the inner compression spring 10, the first deflection element 32 is movable relative to the reference axis A or to the forming roller 31. The pitch of the spring can hence be predetermined individually for any chosen portion. In other words, that is to say that the distance between the reference plane and the deflection surface 35 is proportional to the pitch of the inner compression spring 10.

Figure 5:
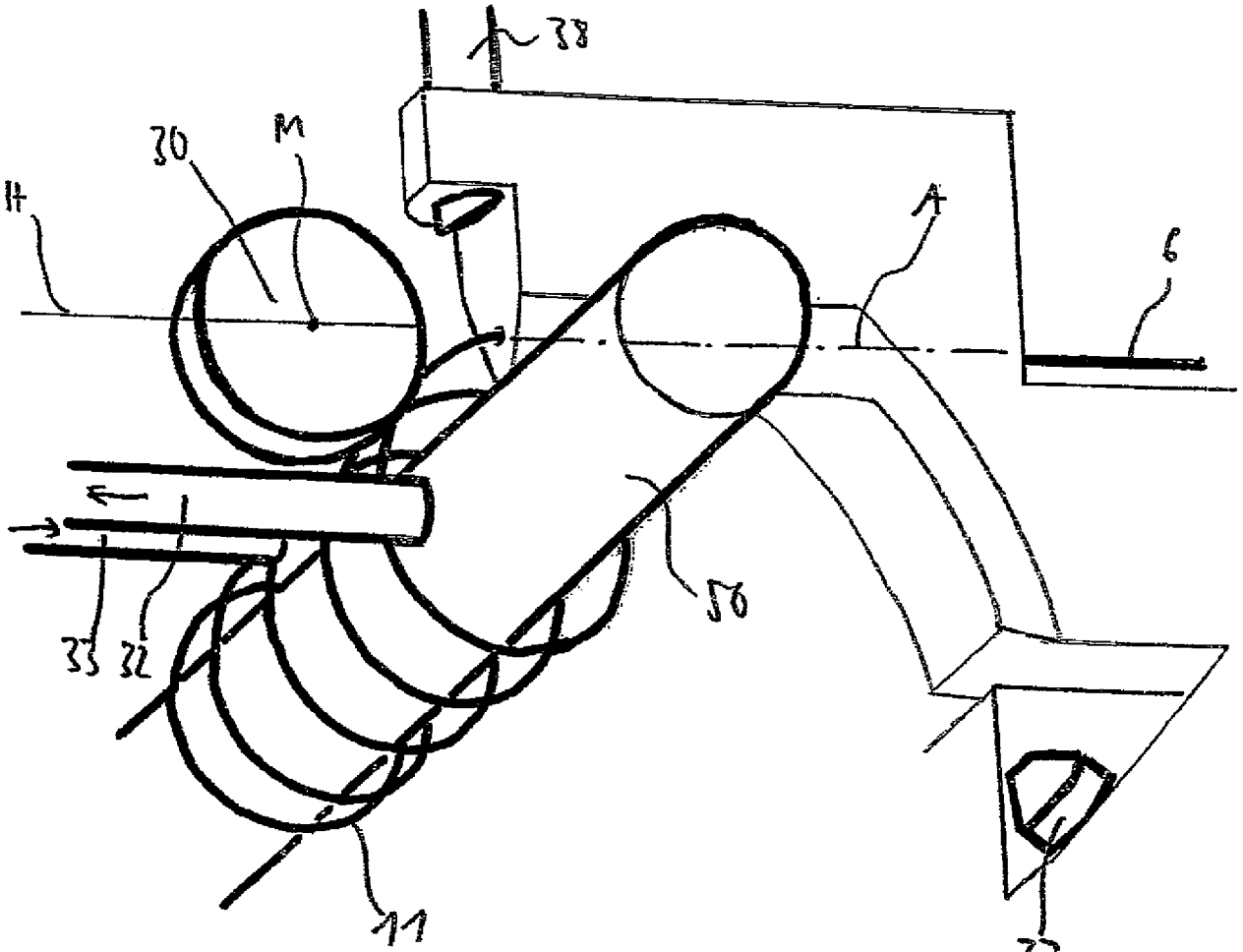

FIG. 5 shows the inner compression spring 10, which has reached the predefined length. In a next step, the first deflection element 32 is now moved from the active position into the rest position and the second deflection element 33 is moved from the rest position into the active position. The movement of the respective deflection elements 32, 33 takes place along the corresponding center axis. This step is represented in greater detail in, FIG. 6.

Figure 6:
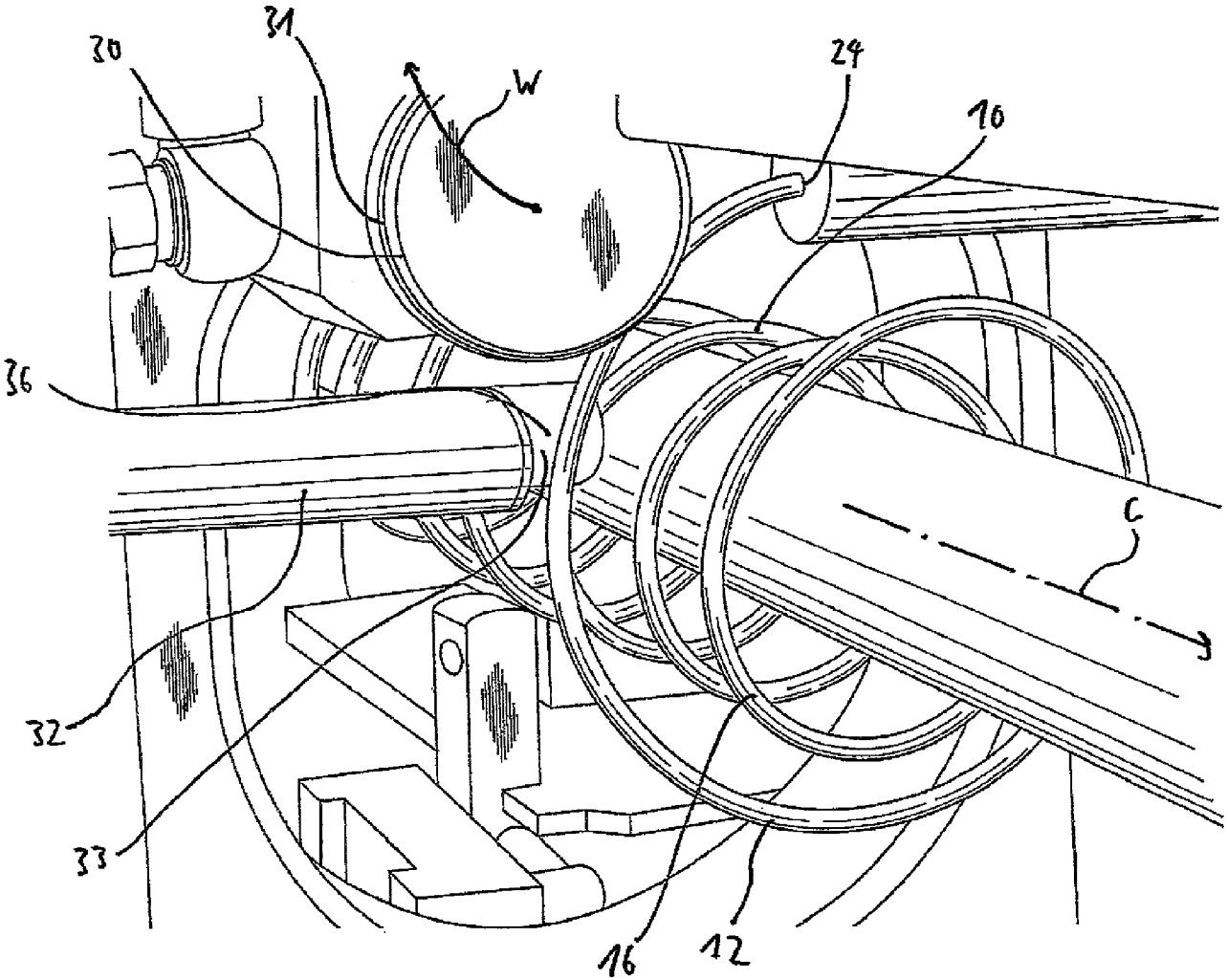

In FIG. 6, the change of direction prior to the production of the outer compression spring 12 is shown. During the change of direction, essentially two different operations occur. On the one hand, the forming roller 30 is swiveled away, in a circular motion, from the position for producing the inner compression spring 10 to the position for producing the outer compression spring 12. This is represented by the arrow W. As the forming roller 30 is being swiveled away, the transition portion 16, which connects the inner compression spring 10 to the outer compression spring 12, is formed.

On the other hand, the first deflection element 33 in engagement with the spring wire 6 is withdrawn from the active position into the rest position and the second deflection element 34 is advanced from the rest position into the active position. From then on, the spring wire 6 is contiguous with the deflection surface 36 of the second deflection element 34. Due to the relative arrangement between the reference axis B and the deflection surface 36, the spring wire is now led in the direction C opposite to the direction B.

Figure 7:
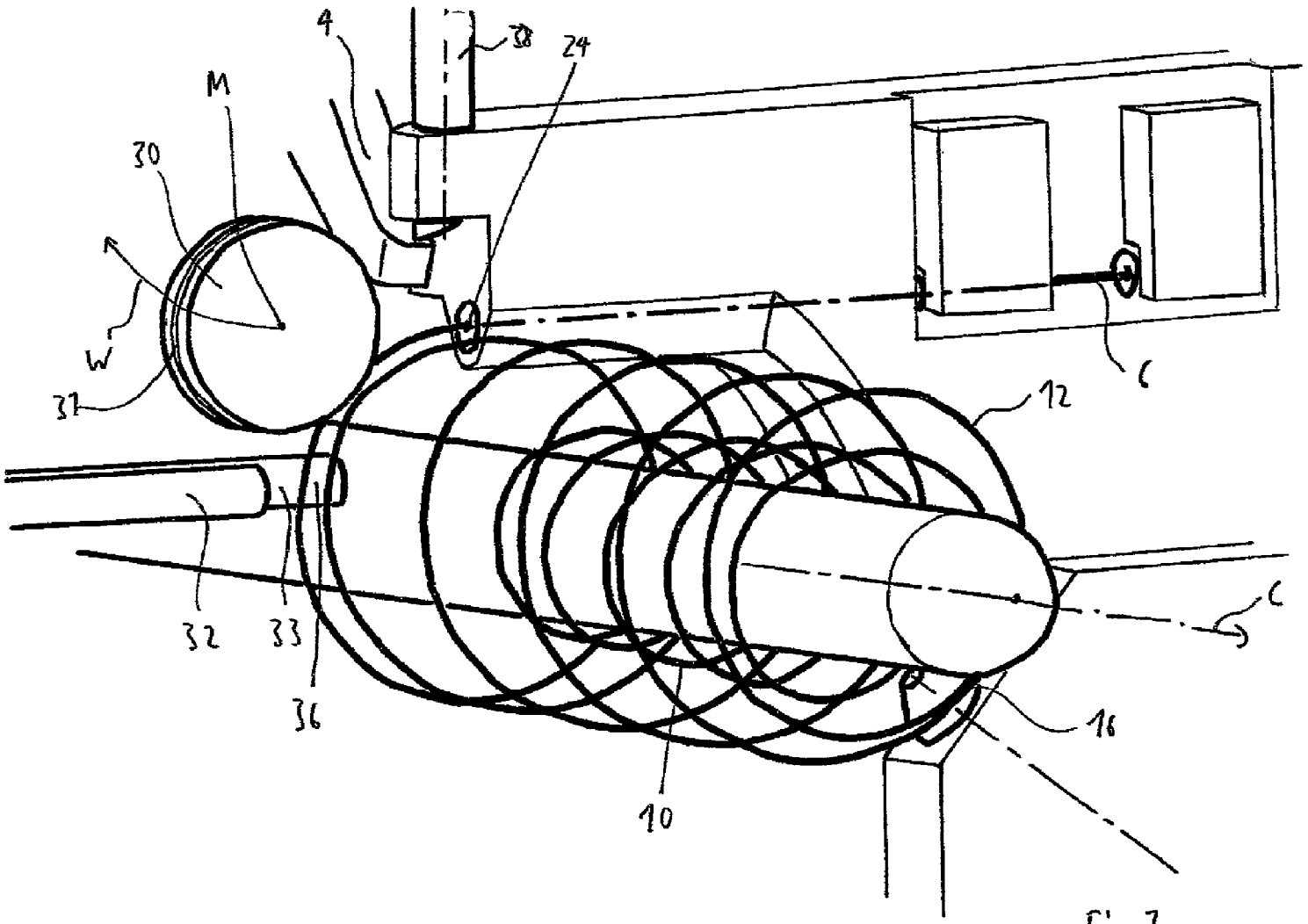

In FIG. 7, the further progression of the spring production is shown. The spring wire 6 is now advanced until such time as the desired spring length of the outer compression spring 12 is reached.

As already mentioned in connection with the inner compression spring 10, the pitch and/or the diameter of the outer compression spring 12 can be easily altered during production operation.

The pitch is altered by the relative positioning of the second deflection element 34 or of the deflection surface 36 to the reference axis A or to the forming groove 31. For this purpose, the second deflection element 34 is slid rearward or forward respectively in the direction B or C. The distance between the reference plane and the deflection surface hence becomes larger if the deflection element is displaced in the direction C and smaller if the deflection element is displaced in the direction B.

By swiveling of the forming roller 30 in the direction W, the diameter is adapted.

In FIG. 7 it can also be seen that the guide pin 50 is still in the front position and guides the compression spring 1 correspondingly. During the production of the outer compression spring 12, the guide pin 50 is slid forward in the direction C in order to guide the multiple compression spring 1. The multiple compression spring 1 is thus prevented from being set in vibration during production. Alternatively, instead of the rear guide pin, a front guide pin is also advanced counter to the direction C from the front side. This has the advantage that the time which is required to withdraw the guide pins from the compression spring 1 is less than if a single guide pin is present.

Figure 8:
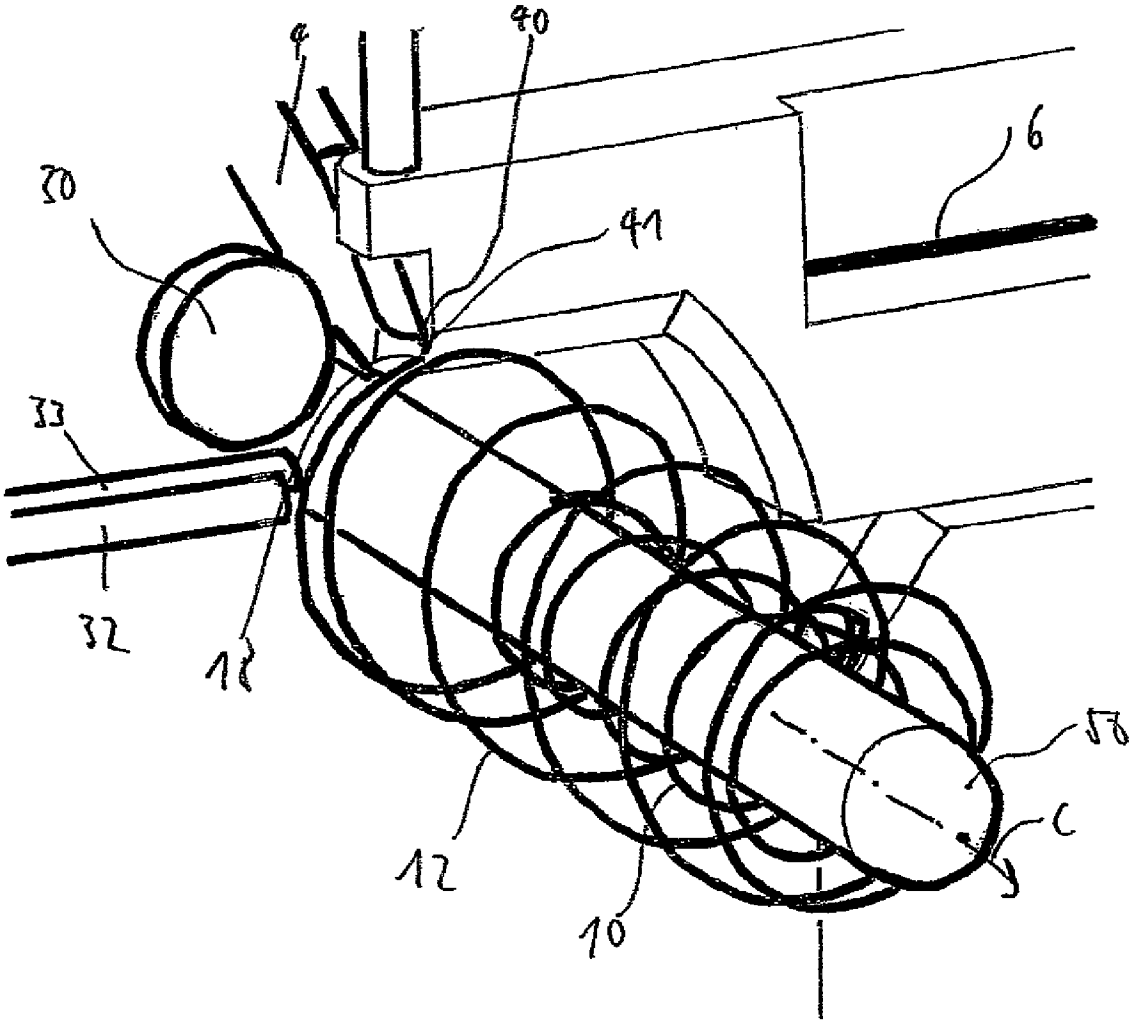

FIG. 8 shows the last step of the production process, wherein the cutting unit 4 here separates the compression spring 1 from the spring wire 6 with the cutting blade 40. With this operation, the second end 18 is at the same time shaped. Prior to the cutting operation, the spring is gripped by a gripping element known from the prior art and can then be led away after the cutting operation.

After the cutting operation, the second deflection element 33 is withdrawn from the active region and the first deflection element 32 is advanced into the active region, so that the starting position is restored. At the same time, the forming roller 30 is brought into the position in which the inner compression spring 10 can be wound.

It is an advantage of the present apparatus and of the present method that it is possible to produce a spring, the pitch and diameter of which is freely adjustable over the length of the spring, whereby a spring of any chosen shape can be produced.

The invention claimed is:

1. A method for producing a spring from a spring wire, comprising the steps of:

producing coils of a first spring part, which produced coils move in a first direction, by feeding the spring wire to a forming roller and a first deflection element, and producing coils of a second spring part thereafter, which latter produced coils move in a second direction, by feeding the spring wire to the forming roller and a second deflection element, wherein said second direction is different from the first direction, wherein the coils of the first spring part are movable along a first center axis in the first direction, and wherein the coils of the second spring part are movable along a second center axis in the second direction.

2. The method as claimed in claim 1, wherein said second direction is opposite to said first direction.

3. The method as claimed in claim 1, further comprising, during a changeover from the first deflection element to the second deflection element, pivoting the forming roller and forming a transition portion from end coils of the first spring part and end coils of the second spring part, by which transition portion the first spring part is connected to the second spring part.

4. The method as claimed in claim 1, further comprising displacing the first deflection element relative to the forming roller to alter the pitch of the first spring part.

5. The method as claimed in claim 1, further comprising displacing the second deflection element relative to the forming roller to alter the pitch of the second spring part.

6. The method as claimed in claim 1, further comprising moving the forming roller to alter the diameter of the first spring part.

7. The method as claimed in claim 1, further comprising moving the forming roller to alter the diameter of the second spring part.

8. The method as claimed in claim 1, wherein diverting the spring wire by a guide element before it impinges on the forming roller in the direction of the forming roller, wherein the guide element diverts the spring wire only until such time as a first complete coil is formed.

9. The method as claimed in claim 1, diverting the spring wire after the spring wire leaves the forming roller and/or the first and second deflection elements by a guide element in the first or second direction, wherein the guide element diverts the spring wire until such time as at least a first complete coil is formed.

10. The method as claimed in claim 1, wherein the spring is configured as a multiple compression spring, the first spring part being an inner compression spring part and the second spring part being an outer compression spring part, wherein the inner compression spring part is disposed within the outer compression spring part.

11. The method as claimed in claim 1, further comprising producing a third, fourth, fifth or sixth spring part.

12. An apparatus for producing a spring from a spring wire, said apparatus comprising:

a forming unit adapted to produce coils of a first spring part, said produced coils being movable in a first direction, and adapted to produce coils of a second spring part thereafter, wherein these produced coils of the second spring part are movable in a second direction which is different from the first direction, wherein the forming unit comprises at least one forming roller, a first deflection element and a second deflection element, wherein the spring wire can be fed to the forming roller, whereupon the forming roller forms the spring wire, and wherein the first deflection element is designed to define a pitch of the first spring part and the second deflection element is designed to define a pitch of the second spring part.

13. The apparatus as claimed in claim 12, wherein said second direction is opposite to said first direction.

14. The apparatus as claimed in claim 12, wherein the first deflection element and the second deflection element are movable from a rest position into an active position, in which the first and second deflection elements deflect the spring wire respectively such that the coils of the first spring part are movable in a first direction and that the coils of the second spring part are movable in a second direction.

15. The apparatus as claimed in claim 12, wherein the first deflection element and the second deflection element are displaceable with respect to a forming roller, whereby a pitch of the first and second spring parts is adjustable.

16. The apparatus as claimed in claim 12, wherein the forming roller is pivotably arranged, so that the diameter of the respective spring part is variable.

17. The apparatus as claimed in claim 12, wherein the apparatus comprises a guide element, which is arranged between a feed unit and a forming roller and which is movable from a rest position into an active position, in which the spring wire can be led in the direction of the forming roller.

18. The apparatus as claimed in claim 12, wherein the apparatus comprises a guide element, which, viewed in a direction of the spring wire, is disposed after a forming roller and which is movable from a rest position into an active position, in which the spring wire can be led in a direction of the respective center axis of the spring.

* * * * *